United States Patent [19]

Eigenmann

[11] 3,958,891

[45] May 25, 1976

[54] AGGREGATE ELEMENTS FOR IMPROVING ANTI-SKID AND VISIBILITY PROPERTIES OF TRAFFIC REGULATING MARKINGS ON ROADWAY PAVEMENTS

[76] Inventor: Ludwig Eigenmann, Vacallo, Ticino, Switzerland

[22] Filed: Mar. 11, 1974

[21] Appl. No.: 450,225

[30] Foreign Application Priority Data

Mar. 12, 1973 Italy ..... 21473/73
May 30, 1973 Italy ..... 24864/73

[52] U.S. Cl. ..... 404/16; 404/20
[51] Int. Cl.[2] ..... E01F 9/04
[58] Field of Search ..... 404/14, 16, 9, 20; 117/33; 116/63 R

[56] References Cited

UNITED STATES PATENTS

| | | | |
|---|---|---|---|
| 1,364,950 | 1/1921 | O'Hara | 404/16 X |
| 1,986,591 | 1/1935 | Meyer | 404/14 |
| 2,229,179 | 1/1941 | Langdon | 404/16 |
| 3,005,790 | 10/1961 | Wynn | 404/14 X |
| 3,043,196 | 7/1962 | Palmquist | 404/9 X |
| 3,164,071 | 1/1965 | Rubenstein | 404/16 X |
| 3,274,888 | 9/1966 | Vanstrum | 404/9 X |
| 3,291,011 | 12/1966 | Defregger | 404/14 X |
| 3,418,896 | 12/1968 | Rideout | 404/14 X |
| 3,556,637 | 1/1971 | Palmquist | 404/16 X |
| 3,782,843 | 1/1974 | Eigenmann | 404/9 |

*Primary Examiner*—Nile C. Byers
*Attorney, Agent, or Firm*—Michael J. Striker

[57] ABSTRACT

There are described elements designed to be partially embedded and secured in a marking layer on a roadway pavement. Each element consists of an aggregate including a multiplicity of tiny hard and sharp particles, such as crystalline chips, and/or light reflective particles, such as retrocollimating glass beads, in a high cohesion resinous binder network, such as of an epoxy or a polyurethane resin. The elements are exceptionally resistant to shocks and to shearing stresses and are capable of being progressively worn off by traffic, concurrently with the wearing off of the marking layer, while their ability to improve anti-skid proper and the nighttime visibility of the marked areas is unaffected by such wearing off.

25 Claims, 8 Drawing Figures

Fig. 1
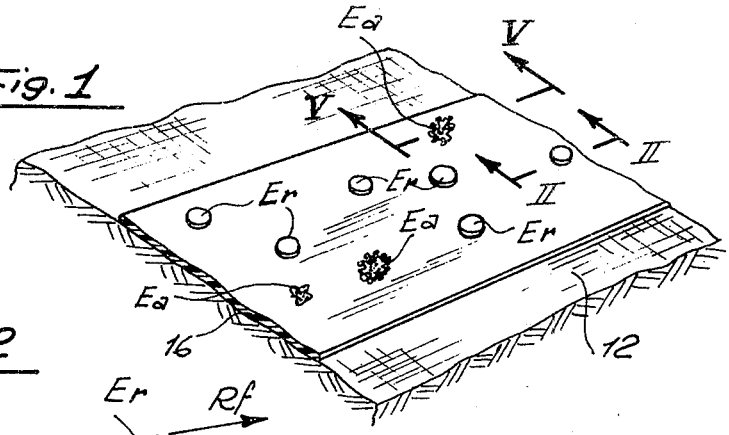
Fig. 2
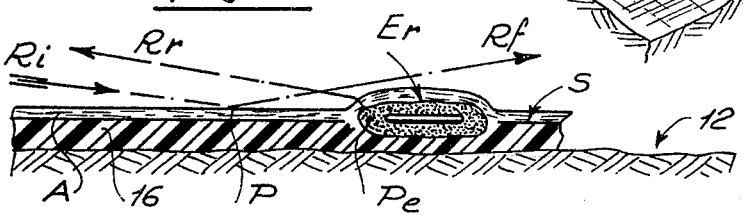
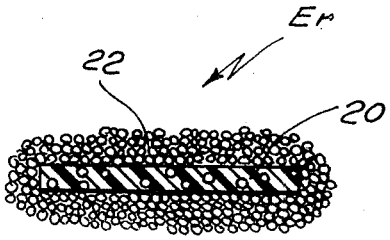
Fig. 3
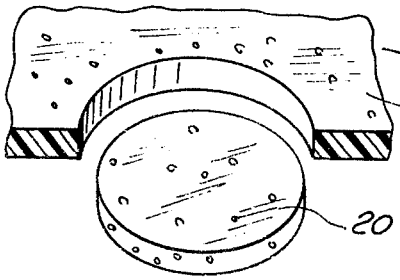
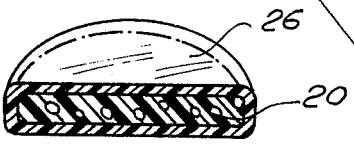
Fig. 4
Fig. 5
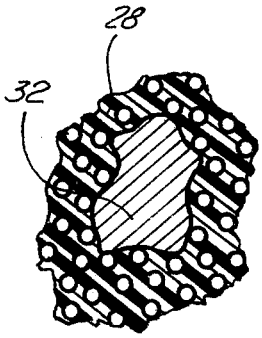
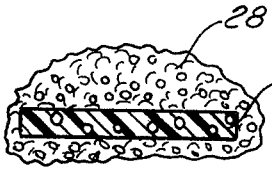
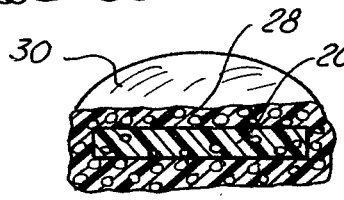

AGGREGATE ELEMENTS FOR IMPROVING ANTI-SKID AND VISIBILITY PROPERTIES OF TRAFFIC REGULATING MARKINGS ON ROADWAY PAVEMENTS

BACKGROUND OF THE INVENTION

1. The Field of the Invention

This invention is concerned with the art of providing roadway and other traffic carrying surfaces with traffic regulating signs, such as traffic lane dividing lines and the like and, more particularly, is concerned with means for improving the anti-skid properties and/or the nighttime visibility of the marked area of the road surface.

2. The Prior Art

The art of providing roadway pavements with traffic regulating signs is a well worked one and extensive comments about it are unnecessary. Generally, such signs can be provided by painting or otherwise forming the sign on the roadway pavement, or by applying and adhesively securing on said pavement strips or tape materials. In any case a neatly defined and clearly visible sign has a smooth and compact outer surface which is not receptive to nor retentive of dirt, greasy particles and tiny rubbery particles detached from vehicles' tires, so that the sign will maintain its nearly pure white or clear color. Several compositions are well known for providing suitable and wear resistant signs on traffic carrying surfaces.

It is further known that the thus formed smooth marked areas are undesirably skiddish. Further, the visibility of the markings is undesirably low at nighttime when substantially one source of light only is provided by a vehicle's headlamps, expecially in rainy weather, when a film or thin layer of water exists on the road pavement and forms a mirror-like surface thereon.

Various means have been heretofore proposed for at least partially avoiding the undesirable characteristics of the conventionally formed signs. In the prior U.S. Pat. No. 3,587,415 it has been proposed to provide on the smooth highly visible marking area a plurality of spaced plates or reliefs having coarse upper faces to improve the overall anti-skid character of the sign. Such plates are formed of aggregates including resin bonded retroreflective glass beads for improving also the nighttime visibility of the sign.

In my prior U.S. Pat. No. 3,746,425 there has been described a manner for providing aggregates of the above character which include an exceedingly high multiplicity of glass beads for correspondingly increasing the number of the "light spots" contributing to a better nighttime visibility.

With a view towards improving the anti-skid properties of the marked areas, for a substantial contribution to traffic safety, my Canadian Pat. No. 929,696 (U.S. patent application Ser. No. 153,218, filed June 15, 1971, now U.S. Pat. No. 3,782,843) proposes to add to and partially embed in the marking composition a multiplicity of very hard crystals, such as of corundum, to provide on the marked area a multiplicity of hard, sharp and upwardly projecting points adapted to frictionally engage the tire treads and to prevent skidding even if the vehicle is engaged in speeding around a curve or in an emergency braking action.

Reference is hereby made to the disclosures of the above patent literature as to the various compositions, binders, fillers, retroreflective beads, crystalline particles and other substances which, individually considered, can be made use of for carrying out the present invention and which, therefore, will not be described and specified in detail as this description proceeds.

THE PRINCIPAL OBJECTS OF THE INVENTION

The heretofore proposed means, while generally satisfying, are however subject to certain serious limitations. For example, the spaced reliefs of U.S. Pat. No. 3,587,415 are not wholly satisfying. They are required to be pre-formed and pre-positioned and secured to a marking material in tape form. As the marking material becomes thinner and thinner by traffic wear, the aggregate plates can be entirely or partially tripped off. The reliefs also spoil the desirable generally planar upper face of the sign.

Similarly the very efficient anti-skid means consisting of partially embedded hard crystals are torn off as the base sign layer is thinned by wear. Further, such crystals are subject to breakage or splitting apart by flaking under violent shearing stresses (such as that promoted by an emergency braking of the vehicle) and under certain high frequency vibrations which have been found to sometimes occur in a road marking material in service. Additionally, relatively big crystals of the order of one millimeter or so, as necessary for obtaining a substantial jutting up from the sign surface and for an efficient rooting in the marking layer, are undesirably costly on a volume basis.

It is therefore a principal object of this invention to provide new and advantageous elements designed to with be associated to road surface marking materials and which are capable of improving the surface properties of the sign, and are not subject to the above and other objections.

Another object of the present invention is to provide new elements as above adapted to be progressively worn off by the traffic, concurrently with the progressive wearing off of the marking material, while maintaining their efficiency as far as the anti-skid properties and/or the nighttime visibility of the marking sign are concerned.

A further object of the invention is to provide new elements as above which can be firmly secured to the marking layer even if not deeply embedded or rooted therein.

Other important objects and advantages of the invention will be made apparent as this description proceeds.

SUMMARY OF THE INVENTION

Essentially, according to the invention, each new element consists of an aggregate comprising a multiplicity of particles individually adapted for imparting the desired anti-skid or retroreflective properties to the sign surface, from which some particles extend upwardly when the aggregate is partially embedded, and a resinous binder firmly securing said particles to each other, the particles positioned at the surface of the aggregate jointly forming a coarse anti-skid surface and at least some of the thus-positioned particles being capable of reflecting light rays impinging thereon in a direction forming a small angle with the said sign surface.

Said particles consist of tiny hard crystals or of reflective microspheres or tiny glass beads. Preferably, the aggregate comprises both tiny crystals and tiny reflective beads. Also preferably, the aggregate is formed about a core body. In one embodiment, such core body consists of a hard crystal and the aggregate has an approximately spheroidal configuration. In another embodiment of the invention, the core body consists of a small flat disk and the aggregate has an approximately disk-like or flattened configuration.

Most preferably, the resinous binder comprises an epoxy resin or a polyurethane resin, and the aggregate is so formed that the binder completely fills even minimal interspaces between the particles to provide a strong coherent physically unitary structure.

It has been surprisingly found that the resulting composite structure, while capable of acting as an extremely efficient means for imparting the desired anti-skid properties to the surface of the traffic regulating sign, by taking advantage of its coarse outer surface, and while capable of providing the desired improved visibility, by taking advantage of the reflectivity of the uncoated particles located at its said outer surface, is extremely resistant to shearing stresses and violent impacts. Further the said structure is subject to progressive wear upon detachment of particles located at its uppermost portion, such detachment leaving the particles located at the next lower level uncovered and thus positioned for providing the desired effect.

The said structure consists of closely spaced particles embedded in a network of very hard resinous material.

The said network forms, at the outer surface of the aggregate, in the interspaces between the particles, an indented structure which efficiently contributes to the provision of a frictional adherence with vehicle tires. The new element provides therefore an efficient anti-skidding action even if the particles embedded in the said network are not sharply pointed, such as is the case with reflective glass beads.

On the other hand, when the particles are such as to provide the best frictional resistance, such as when the aggregate comprises hard, pointed microcrystals, the multiplicity of such crystals which are partially uncovered and located at the exposed surface of an element which is only partially embedded in the marking composition, provides a noticeable reflection of the light due to the refractivity and the internal reflection of the crystalline particles, a part of said reflection of the differently oriented crystals being directed towards the source of light, thus providing substantial retroreflectivity and nighttime visibility.

Further, the above discussed properties of the new element, that is, the ability to provide good frictional resistance for vehicle tires even if not provided with sharply pointed particles, and the ability to provide an exceptionally good resistance to shearing forces, leads to the new advantage that very good and durable anti-skid elements can be manufactured by making use of crystalline or nearly crystalline particles of hard but not very hard materials and compounds. It has been found that exceptionally efficient anti-skid aggregate elements can be made by providing the same with crystals or crushed crystalline scraps of any known substance or compound having a hardness of not less than 6 on the Mohs' Hardness Scale.

These and other objects and advantages of the invention will be apparent from the following detailed description of a few exemplary embodiments of the same invention, shown in the accompanying drawings.

THE SEVERAL VIEWS OF THE DRAWINGS

FIG. 1 is a diagrammatic fragmentary perspective view of a marked road having greatly improved visibility and anti-skid properties due to the provision of the marking material with a multiplicity of the new elements, which are scattered on and protrude above the surface facing away from the roadway pavement;

FIG. 2 is a diagrammatic sectional view, taken in the plane indicated at II—II in FIG. 1, illustrating a new element in service on an enlarged scale, in an embodiment particularly adapted for providing nighttime visibility;

FIG. 3 is a diametral sectional view, in very enlarged scale, of the same element;

FIG. 4 illustrates diagrammatically and perspectively the essential steps of a procedure for constructing the same element;

FIG. 5 is a very enlarged diagrammatic sectional view of another embodiment, taken in the plane indicated at V—V in FIG. 1;

DETAILED DESCRIPTION OF THE PREFERRED EMBODIMENTS

Figure 6:
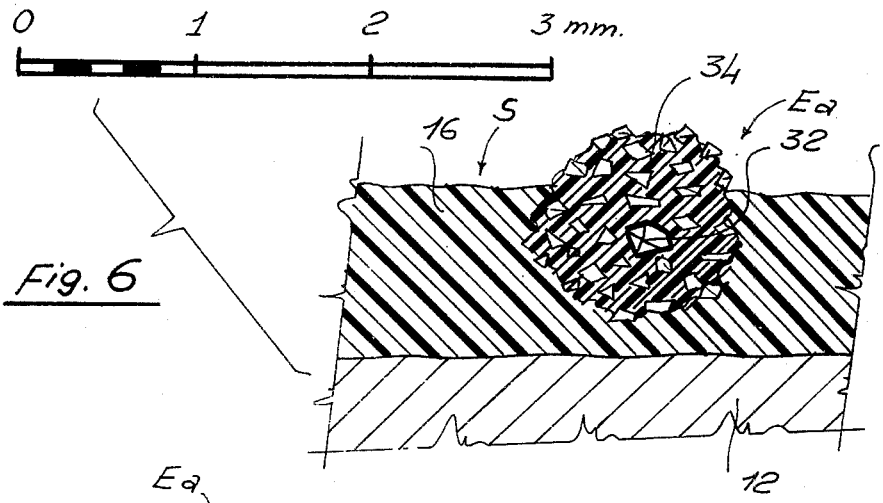
FIG. 6 is a similar view of another embodiment as partially embedded in freshly laid or formed marking material.

FIG. 1 generally visualizes the field and the objects of the invention. A strip or layer of marking material is laid on and secured to the surface of the pavement 12 of a roadway. The layer is generally indicated at 16 and its composition, mode of formation and the manner of securing the same to the pavement form no part of this invention as such art is widely known. Reference is herein made to the above indicated patent literature. Of course, such material is to be chosen from the known types which can receive and embed discrete elements, when the material is in its liquid or viscous state, and then strongly retain such elements when completely cured or set.

Generally, the elements are dropped on and if necessary pressed into the layer 16 of the marking material, either during the production thereof, if in tape form, or before setting thereof on the road pavement, if the marking has been painted or otherwise formed on the pavement. The elements are located on the marked area with spacing in an at least approximately evenly distributed manner and in such number as to provide a convenient average population of protruding parts as necessary to impart the desired nighttime visibility and anti-skid properties to the marked area. Advantageously, as diagrammatically indicated in FIG. 1, elements of different types are combined to provide the best compromise of the said properties. Thus, in the marked areas, specifically "good adherence" elements Ea are mixed with specifically "good reflectivity" elements Er. As described below, elements Ear (FIG. 8) possessing both said properties can be provided and made use of according to the invention.

FIG. 2 illustrates how a "good reflectivity" element Er is partly embedded and firmly secured in the layer 16 of the marking material over the road pavement 12. This element Er has however an upper exposed coarse face which provides also a noticeable improvement in the anti-skid property. As shown in FIG. 3, this element has a resinous core body 20 and a multi-layer coating 22 of retroreflective beads, having diameters known type, of from a few microns to say 100 microns, preferably from 20 to 50 microns, such dimensions not being limiting for the invention.

The rounded edge portion of the element, protruding above the surface S of the marked area, provides a multiplicity of particles (the beads), each capable of retroreflection. The arrow Rr diagrammatically indicates how a light ray is returned essentially in the direction of light impingement.

The provision of even a relatively few retroreflective elements provides an exceptionally improved nighttime visibility in rainy weather, when a film or thin layer of water exists over the road pavement and marked areas, said watery layer being indicated at A in FIG. 2. As is well known to motorists, in rainy weather, and when essentially the sole source of light is provided by the vehicle's headlamps, the traffic dividing lines and other signs on the roadway pavement seem to "disappear" with serious prejudice for the traffic safety.

FIG. 2 visualizes this undesirable phenomenon. The watery layer A provides a mirror-like reflective surface. An incident light ray such as indicated at Ri impinges say at point P under an angle of incidence near 90° and corresponds to that emitted by a headlamp at a distance of 10–20 meters from point P. This ray is completely reflected away from the vehicle, as indicated by the reflected ray Rf and therefore in such weather conditions the indicia formed on a roadway pavement cannot actually be seen by the motorist from beyond an undesirably short distance away therefrom. A light ray which however impinges, from the same direction, on the rounded protruding edge of the element Er, or more properly on the watery layer A which conforms to the protrusion and which, evidently impinges at a much smaller angle of incidence, passes back and forth through the layer, e.g., by reflection from point Pe, and is nearly entirely retrocollimated as indicated at Rr, thus providing the desired visibility of the marking.

This element Er can be manufactured by cutting or punching small disks 20 (of from 1 to 3 millimeters diameter, for example) from a calendered tape 24 of a suitable resinous material, such as an epoxy or a polyurethane resin, having a thickness of 0.1 to 0.5 millimeter, for example, and preferably but not necessarily having some tiny reflective beads incorporated therein, as shown in FIG. 4. This disk 20 is coated with a layer 26 of a resinous binder and, before setting of such layer 26, with a first monolayer 28 of reflective beads. Upon substantial setting of the binder (suitable heating can provide a very fast curing, as is well known), a further layer 30 of binder and a further monolayer of beads are applied. These steps are repeated until the desired coating of beads 22 of FIG. 3 is provided. Tiny crystals or crystalline scraps or chips can be mixed with the beads for improving the adherence property.

Upon the provision of a flat core body such as the tiny disk 20, an essentially flat element Er is formed. Such flatness provides both a relatively large upper face for good adherence (provided by the coarseness of such face) and a tendency of the element to spontaneously lay flat on the marking material, whether the element is dropped on and pressed into the marking material or whether the element is applied to marking material which is prefabricated in tape form.

The element Er as above described is serviceable and efficient until the multi-layer 22 of beads on its core body 20 is completely worn off by the traffic due to progressive detachment of its individual beads.

According to the embodiment of FIG. 5, a bonded multi-layer of retroreflective beads is formed about a crystalline core 32. The layers 28 of beads are much more closely spaced than illustrated in FIG. 5 (as are the reflective and crystalline particles in FIGS. 6 to 8), the views being enlarged for a better showing of the resinous network formed by the binder. This element has a generally spheroidal configuration and therefore provides a more sharply protruding body when not worn, for better engagement with the vehicle tires. As its uppermost portion is worn off (thus leading to a flatter protrusion having less grip for a tire) the upper point of the crystalline core body 32 will be uncovered thus providing a sharply pointed protrusion. This element might therefore be considered as a combined "good visibility and good adherence" aggregate. Reflective beads can however be mixed with sharp crystalline particles when such an element is manufactured.

A specifically "good adherence" element Ea is shown in FIG. 6. A metric scale associated with said FIG. 6 exemplifies the dimensions of the element and its components. In such element Ea a smaller crystalline core 32 is coated with a multi-layer 34 of tiny crystals or chips of a hard crystalline substance. This element in shown in FIG. 6 as being rather deeply embedded in a layer 16 of still unworn marking material on a roadway pavement 12. This element however protrudes considerably above the surface S of the marking layer 16 for imparting the desired properties thereto.

Figure 7:
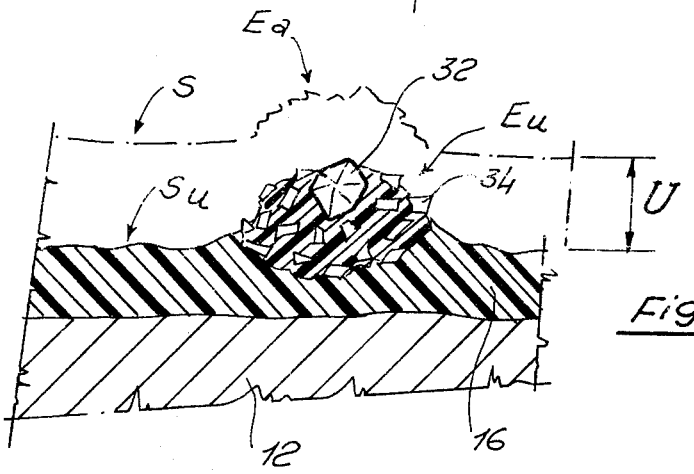
FIG. 7 is a view similar to that of FIG. 6, but showing the same element and marking material after a substantial wearing off due to severe traffic.

FIG. 7 illustrates the same element after a substantial wearing away of the same, concurrently with the wearing away of the marking layer 16, the profile of the unworn element and layer being indicated by a dot-and-dash line in FIG. 7. Assuming that a substantial portion U of the marking layer 16 has been worn away by the traffic (while the marking efficiency of the layer is not, or not substantially, affected), the element Ea, if it was not physically and dimensionally modified, would remain proportionately insufficiently embedded below the worn surface Su of the layer 16. If an element was be made of an integrally formed body, such as a monocrystal of similar overall dimensions, it would be entirely torn off from the marking layer 16, well before the wearing away of said layer to the extent indicated at U.

On the contrary, the new aggregate structure of the element Ea wears away concurrently with the the marking layer 16. The thus progressively worn away element, such as indicated at Eu in FIG. 7, (a) protrudes above the worn away surface Su of the marking layer, forming an essentially conical protrusion with a portion of the core 32 constituting the tip thereof, and (b) remains embedded within the layer 16 to a depth which, proportionately, is well related to the extent of its protrusion. The indented coarse lower face of the element ensures a firm bond with the composition of the layer 16, even if the element hardly projects therein. FIG. 7 is an enlarged realistic representation of a partially worn but still quite efficient element, still firmly bound to a nearly completely worn marking layer of a polyurethane resin based composition.

It is therefore evident that the invention provides an extremely advantageous means for sharply improving the visibility and anti-skid properties of a compact and smooth road surface marking material, having a surface S which is not receptive to dirt, and where the layer having such surface is subject to progressive wear and thinning, said properties being unaffected by said wear and being maintained for essentially the entire service life-time of the road marking material.

Figure 8:
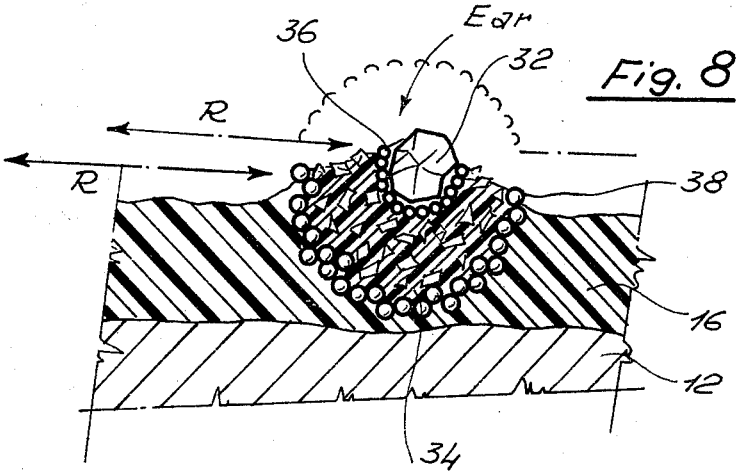
FIG. 8 is a view similar to that of FIG. 7, showing a further and preferred embodiment of the invention.

FIG. 8 illustrates how the element of FIGS. 6 and 7 can be modified for a better contribution to the above discussed nighttime visibility. Layers of retrocollimating beads can be altered with layers of hard and pointed crystalline particles or chips. For example, a first layer 36 of beads can be formed about a crystalline core 32 followed by a plurality of layers 34 of tiny crystals or crystalline chips, and this then followed by a further monolayer or even a multilayer 38 of beads about the aggregate of crystalline particles.

While not substantially worn, the thus provided combined "good visibility and good adherence" element Ear of FIG. 8 behaves as the element of FIG. 5 does. As soon as its convex protruding tip is flattened by traffic, the hard crystalline particles begin to be uncovered for improving the adherence, this being promoted by such flattening. The desired combined properties are maintained and even improved by the wearing down, as is illustrated in FIG. 8, where the double pointed arrows R indicate impinging and retrocollimated light rays, and as is also illustrated in FIG. 7, until the road surface marking is no longer serviceable.

I claim:

1. As a novel article, an aggregate for securing in a layer of material which is used to form a traffic-regulating indicium, so as to improve the nighttime visibility characteristics and anti-skid characteristics of the traffic-regulating indicium, said aggregate comprising a core body; a mass of a shock-absorbent binder substance at least partially surrounding said core body; and a plurality of elements for improving at least one of said characteristics arranged in and bound by said binder substance such that the latter substantially fills the interspaces between at least the majority of adjacent pairs of said elements, some of said elements being arranged adjacent an external surface of said mass so as to impart a roughened texture to said external surface thereby permitting said aggregate to be firmly secured in the traffic-regulating indicium, and the remainder of said elements being distributed among different levels interiorly of said mass so that progressive wear of said aggregate and concomitant detachement of elements from the latter causes exposure of others of said elements thereby permitting said aggregate to substantially continuously impart improved characteristics to the traffic-regulatiing indicium.

2. An article as defined in claim 1, wherein said elements are arranged in a plurality of substantially concentric layers about said core body.

3. An article as defined in claim 1, wherein said binder substance conprises a member of the group consisting of epoxy resins and polyurethane resins.

4. An article as defined in claim 1, wherein said core body comprises a crystal having a minimum hardness of about 6 on the Mohs' Hardness Scale.

5. An article as defined in claim 4, wherein said elements comprise crystalline particles and retroreflective beads arranged in closely spaced relationship, said elements being arranged in substantially concentric layers about said core body, and alternate ones of said layers being substantially entirely constituted by said crystalline particles and said retroreflective beads, respectively.

6. An article as defined in claim 1, wherein said core body comprises a disc of a resinous composition and said aggregate has a flattened overall configuration.

7. An article as defined in claim 1, wherein said elements comprise crystalline particles having a minimum hardness of about 6 on the Mohs' Hardness Scale.

8. An article as defined in claim 7, wherein at least some of said particles are in the form of chips.

9. An article as defined in claim 1, wherein said elements comprise retroreflective beads.

10. An article as defined in claim 1, wherein said aggregate has an average dimension between about 1 and 3 millimeters.

11. As a novel article, an aggregate for securement in a layer of material, which is used to form a traffic-regulating indicium, so as to improve the nighttime visibility characteristics and the anti-skid characteristics of the traffic-regulating indicium, said aggregate comprising a crystalline core body having a plurality of projecting tips; a shock-absorbent binder substance at least partially surrounding said core body; and a plurality of elements for improving at least one of said characteristics arranged in and bound by said binder substance such that the latter substantially fills the interspaces between at least the majority of adjacent pairs of said elements, some of said elements being arranged adjacent an external surface of said binder substance so as to impart a roughened texture to said external surface thereby permitting said aggregate to be firmly secured in the traffic-regulating indicium, and the remainder of said elements being arranged in a plurality of approximately concentric layers about said core body and interiorly of said binder substance so that progressive wear of said aggregate and concomitant detachment of elements from the latter causes exposure of others of said elements and eventually of one of said tips thereby permitting said aggregate to substantially continuously impart improved characteristics to the traffic-regulating indicium.

12. An article as defined in claim 11, wherein said binder substance comprises a member of the group consisting of epoxy resins and polyurethane resins.

13. An article as defined in claim 11, wherein said elements comprise crystalline particles having a minimum hardness of about 6 on the Mohs' Hardness Scale.

14. An article as defined in claim 11, wherein said elements comprise retroflective beads.

15. An article as defined in claim 11, wherein said core body has a minimum hardness of about 6 on the Mohs' Hardness Scale.

16. An article as defined in claim 15, wherein said elements comprise retroreflective beads, and crystalline particles having a minimum hardness of about 6 on the Mohs' Hardness Scale.

17. A marked road, comprising a roadway pavement; and a traffic-regulating indicium provided on said pavement and including a layer of material having an upwardly directed surface, said indicium further including a plurality of spaced aggregates secured to said layer and projecting upwardly of said surface so as to impart improved nighttime visibility characteristics and anti-skid characteristics to said layer, said aggregates comprising a core body; a mass of a binder substance at least partially surrounding said core body and having a surface portion located interiorly of said layer; and a plurality of elements for improving at least one of said characteristics arranged in and bound by said binder substance such that the latter substantially fills the interspaces between at least the majority of adjacent pairs of said elements, some of said elements being arranged adjacent said surface portion so as to impart a roughened texture to the latter thereby causing said aggregates to be firmly anchored in said layer, and the remainder of said elements being distributed among different levels interiorly of said mass so that progressive wear of said aggregates and concomitant detachment of elements from the latter causes exposure of others of said elements thereby permitting said aggregates to substantially continuously impart improved characteristics to said layer.

18. A marked road as defined in claim 17, wherein the rate of wear of said aggregate approximates that of said layer so that said aggregate imparts improved characteristics to said layer for approximately the lifetime of said layer.

19. A marked road as defined in claim 17, wherein said binder substance comprises a member of the group consisting of epoxy resins and polyurethane resins.

20. A marked road as defined in claim 17, wherein said core body comprises a crystal having a minimum hardness of about 6 on the Mohs' Hardness Scale.

21. A marked road as defined in claim 20, wherein said elements comprise crystalline particles and retroreflective beads, said elements being arranged in approximately concentric layers about said core body, and alternate ones of said layers being substantially entirely constituted by said crystalline particles and said retroflective beads, respectively.

22. A marked road as defined in claim 17, wherein said core body comprises a disc of a resinous composition.

23. A marked road as defined in claim 17, wherein said elements comprise crystalline particles having a minimum hardness of about 6 on the Mohs' Hardness Scale.

24. A marked road as defined in claim 17, wherein said elements comprise retroflective beads.

25. A marked road as defined in claim 17, wherein said one aggregate has an average dimension between about 1 and 3 millimeters.

* * * * *